US009810405B2

(12) United States Patent
Yang et al.

(10) Patent No.: US 9,810,405 B2
(45) Date of Patent: Nov. 7, 2017

(54) ELECTRONIC CANDLE

(71) Applicant: Shenzhen Ningrui Electronical Technology Co., Ltd., Shenzhen, Guangdong (CN)

(72) Inventors: Jiliang Yang, Chongqing (CN); Shihai Zou, Jiujiang (CN)

(73) Assignee: SHENZHEN NINGRUI ELECTRONICAL TECHNOLOGY CO., LTD., Guangdong (CN)

( * ) Notice: Subject to any disclaimer, the term of this patent is extended or adjusted under 35 U.S.C. 154(b) by 147 days.

(21) Appl. No.: 15/001,990

(22) Filed: Jan. 20, 2016

(65) Prior Publication Data

US 2017/0089548 A1 Mar. 30, 2017

(30) Foreign Application Priority Data

Sep. 30, 2015 (CN) ..... 2015 1 0642196

(51) Int. Cl.

| | |
|---|---|
| ***F21V 14/02*** | (2006.01) |
| ***F21V 14/08*** | (2006.01) |
| ***F21V 33/00*** | (2006.01) |
| ***F21L 4/02*** | (2006.01) |
| ***F21V 7/00*** | (2006.01) |
| ***F21V 13/08*** | (2006.01) |
| ***F21V 14/04*** | (2006.01) |
| ***F21V 23/00*** | (2015.01) |
| ***F21V 23/04*** | (2006.01) |
| *F21Y 103/10* | (2016.01) |

(52) U.S. Cl.

CPC ..... *F21V 14/085* (2013.01); *F21L 4/02* (2013.01); *F21V 7/0008* (2013.01); *F21V 13/08* (2013.01); *F21V 14/045* (2013.01); *F21V 23/004* (2013.01); *F21V 23/0414* (2013.01); *F21V 33/0028* (2013.01); *F21Y 2103/10* (2016.08)

(58) Field of Classification Search

None

See application file for complete search history.

(56) References Cited

U.S. PATENT DOCUMENTS

2015/0109786 A1* 4/2015 Li ..... F21S 6/001 362/277

2016/0116127 A1* 4/2016 Patton ..... F21S 6/001 362/284

* cited by examiner

*Primary Examiner* — Britt D Hanley

(74) *Attorney, Agent, or Firm* — Schmeiser, Olsen & Watts, LLP

(57) ABSTRACT

The invention discloses an electronic candle, comprising a plastic shell, wherein a spring is arranged inside the plastic shell, an upright metal wire is arranged at the upper end of the spring, a metal ring is arranged at the lower end of the spring, the metal wire is sleeved with an included angle reflecting screen, a plurality of color flame projectors matched with the included angle reflecting screen are arranged on the plastic shell above the spring, a supporting rod with a concave point is arranged on the plastic shell below the spring, a metal hook is arranged at the metal ring bottom, and a driver for driving the soft iron sheet to swing and an overall power supply for supplying power to the driver and the color flame projectors are arranged below the soft iron sheet. The invention achieves a good effect in reasonable structural design and decorative lighting.

10 Claims, 9 Drawing Sheets

ELECTRONIC CANDLE

FIELD OF THE INVENTION

The present invention relates to the field of lighting appliances, and particularly relates to an electronic candle.

BACKGROUND OF THE INVENTION

In daily life, candlelight is often used to decorate the atmosphere, but the traditional candle is not quite convenient, because the candle conventionally produces a high-temperature flame, which not only increases the concentration of carbon dioxide in air, but also has great potential safety hazards, the resource utilization rate is low and the requirements for energy conservation and environment friendliness are not met. If an electronic candle using a lamp as a luminous element is directly used, it is unreal and unsatisfactory in atmosphere decoration effect, thus influencing people's feelings.

SUMMARY OF THE INVENTION

An object of the present invention is to design an electronic candle for solving the above problems.

A technical solution of the present invention for achieving the above object is an electronic candle, including a plastic wrapper and a white wax shell, wherein a spring is arranged inside the plastic wrapper and the white wax shell, an upright metal wire is arranged at the upper end of the spring, a metal ring is arranged at the lower end of the spring, the metal wire is sleeved with an included angle reflecting screen, a plurality of color flame projectors matched with the included angle reflecting screen are arranged on the plastic shell above the spring, a supporting rod with a concave point is arranged on the white wax shell below the spring, the supporting rod with the concave point transversely penetrates through the metal ring, a metal hook is arranged at the lower end of the metal ring, a soft iron sheet is connected to the metal hook, and a driver for driving the soft iron sheet to swing and an overall power supply for supplying power to the driver and the color flame projectors are arranged below the soft iron sheet.

The included angle reflecting screen is formed jointly by a plurality of milky films distributed on the same center line at equal angles, and a circular hole for sleeving on the metal wire is formed at the lower end of the center line.

The quantity of the plurality of color flame projectors is the same as that of the milky films, the plurality of color flame projectors are distributed on the same circumference at equal angles with the included angle reflecting screen as a center, and each color flame projector is located in a relationship of one-to-one correspondence with the included angle between two adjacent milky films.

Each color flame projector is jointly composed of a support, color tubes arranged on the support, a color flame film and a convex lens.

The color tubes are jointly composed of red, white and yellow LED tubes.

The driver is composed of a circuit board and an electromagnetic coil fixed on the circuit board.

The overall power supply is formed by connecting a power supply and a power switch in series.

The power supply and the power switch are respectively electrically connected with the circuit board to form a closed circuit, and the circuit board is electrically connected with the color tubes.

The included angle between the two adjacent milky films of the included angle display screen is 120 degrees and corresponds to a flame projector.

The metal ring is positioned within an area of the supporting rod where the concave point is located.

Each of the spring, the metal wire at the upper end of the spring, the metal ring at the lower end of the spring and the metal hook at the lower end of the metal ring is formed by winding a steel wire.

According to the electronic candle manufactured by using the technical solution of the present invention, a color flame and the included angle reflector are caused to move up and down by electromagnetic pulse drive and spring disturbance, thus producing a candlelight flickering decoration effect, bringing candlelight atmosphere and great flickering reality to the surroundings, meanwhile, solving the original problems of being not environment-friendly and unreal and furthest meeting the pursuit of people's life.

Figure 1:
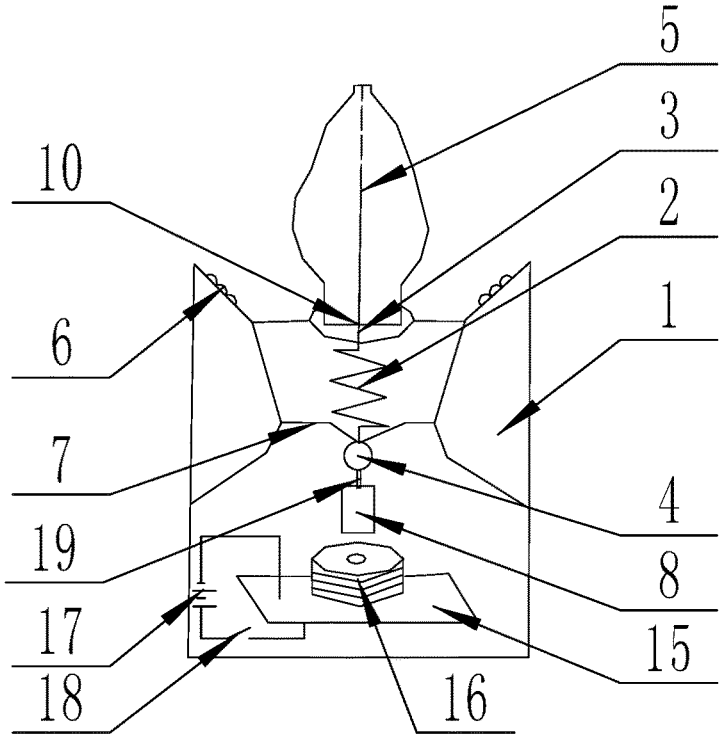
FIG. 1 is a structural schematic diagram of embodiment 1 of the present invention.

Reference numerals: 1, plastic shell; 2, spring; 3, metal wire; 4, metal ring; 5, included angle reflecting screen; 6, color flame projector; 7, supporting rod with concave point; 8, soft iron sheet; 9, milky film; 10, circular hole; 11, support; 12, color tube; 13, color flame film; 14, convex lens; 15, circuit board; 16, electromagnetic coil; 17, power supply; 18, power switch; 19, metal hook; 20, long spring; 21, positioning column; 22, base; 23, linear spring.

DETAILED DESCRIPTION OF THE EMBODIMENTS

The embodiments of the present invention will be specifically described below in conjunction with the accompanying drawings.

Embodiment 1

Figure 2:
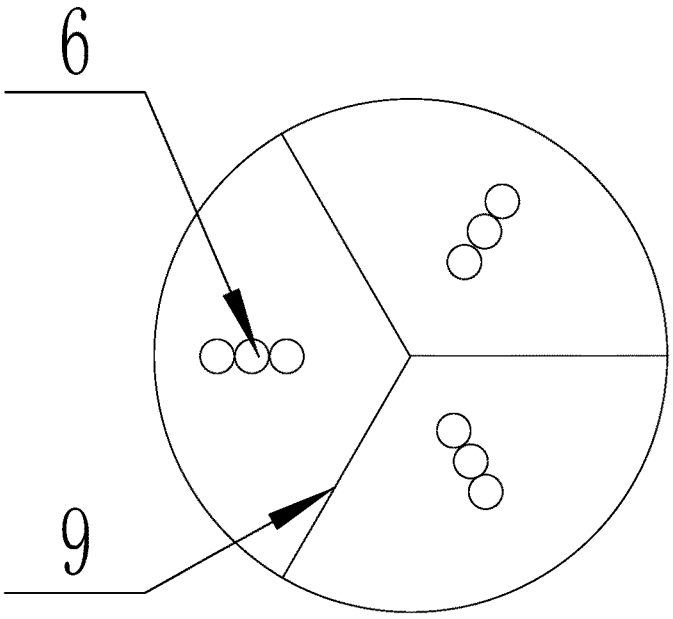
FIG. 2 is a structural schematic diagram of an included angle reflecting screen in embodiment 1 of the present invention.
Figure 3:
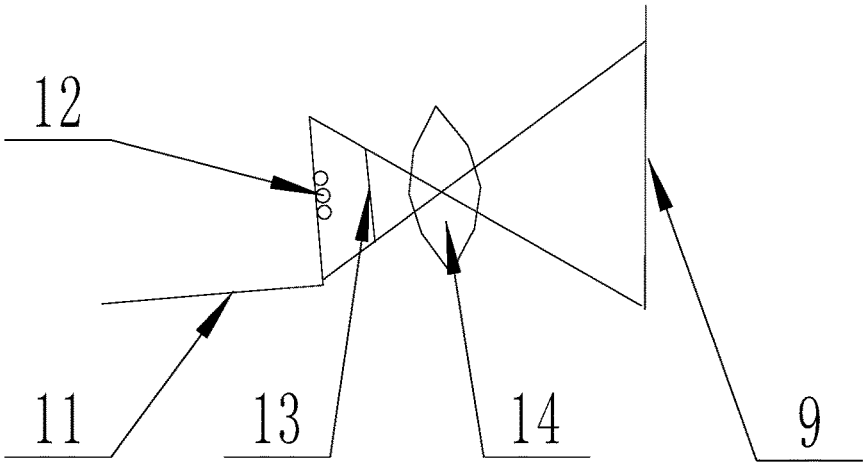
FIG. 3 is a structural schematic diagram of a color flame projector in embodiment 1 of the present invention.

As shown in FIGS. 1-3, an electronic candle includes a plastic wrapper and a white wax shell 1, a spring 2 is arranged inside the plastic wrapper and the white wax shell, an upright metal wire 3 is arranged at the upper end of the spring, a metal ring 4 is arranged at the lower end of the spring, the metal wire is sleeved with an included angle reflecting screen 5, three color flame projectors 6 matched with the included angle reflecting screen are arranged on the plastic shell above the spring, a supporting rod 7 with a concave point is arranged on the white wax shell below the spring, the supporting rod with the concave point transversely penetrates through the metal ring, the metal ring 4 is positioned within an area of the supporting rod where the concave point is located, a metal hook 19 is arranged at the lower end of the metal ring, a soft iron sheet 8 is hooked by the metal hook, and a driver for driving the soft iron sheet to swing and an overall power supply for supplying power to the driver and the color flame projectors are arranged below the soft iron sheet. In this case, the included angle reflecting screen 5 is jointly formed by three milky films 9 distributed on the same center line at equal angles, the included angle between two adjacent milky films is 120 degrees, and a circular hole 10 for sleeving on the metal wire is formed at the lower end of the center line; the quantity of the color flame projectors 6 is the same as that of the milky films, the three color flame projectors are distributed on the same circumference at equal angles with the included angle reflecting screen as a center, and each color flame projector is located in a relationship of one-to-one correspondence with the included angle between the two adjacent milky films; each color flame projector 6 is jointly composed of a support 11, color tubes 12 arranged on the support, a color flame film 13 and a convex lens 14; the color tubes 12 are jointly composed of red, white and yellow LED tubes; the driver is composed of a circuit board 15 and an electromagnetic coil 16 fixed on the circuit board; the overall power supply is formed by connecting a power supply 17 and a power switch 18 in series; the power supply 17 and the power switch 18 are respectively electrically connected with the circuit board to form a closed circuit, and the circuit board is electrically connected with the color tubes. When the power switch is turned on, the whole candle starts working, the color LED tubes start emitting light, and a color flame shadow is formed within the included angle between the two adjacent milky films. Because the current in circuit board can produce intermittent pulse oscillation, the coil produces magnetism; the magnetism instantaneously attracts or releases the soft iron sheet, and the spring is disturbed by intermittent tension to drive the included angle display screen to move up and down, so that a vivid dynamic flame feeling is formed.

Embodiment 2

Figure 4:
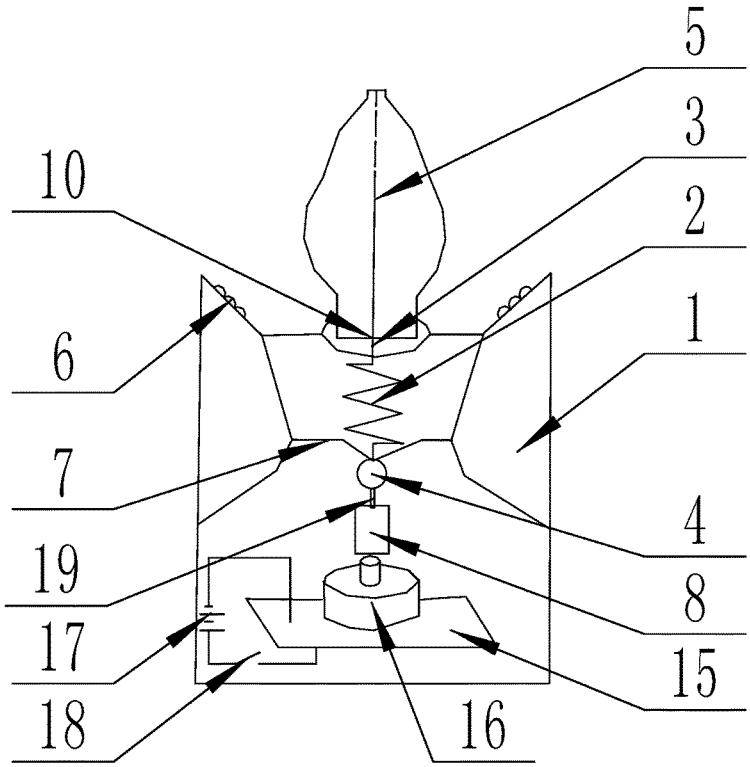
FIG. 4 is a structural schematic diagram of embodiment 2 of the present invention.

As shown in FIG. 4, the driver is composed of a circuit board 15 and a small fan 16 fixed on the circuit board; the overall power supply is formed by connecting a power supply 17 and a power switch 18 in series; the power supply 17 and the power switch 18 are respectively electrically connected with the circuit board to form a closed circuit, and the circuit board is electrically connected with the color tubes. When the power switch is turned on, the whole candle starts working, the color LED tubes start emitting light, and a color flame shadow is formed within the included angle between the two adjacent milky films. Because the current in the circuit board produces intermittent pulse oscillation, the fan starts rotating forwardly or reversely to produce wind power with opposite directions; the wind power instantaneously attracts or releases the soft iron sheet, and the spring is disturbed by intermittent tension to drive the included angle display screen to move up and down, so that a vivid dynamic flame feeling is formed. Others are same as in embodiment 1.

Embodiment 3

Figure 5:
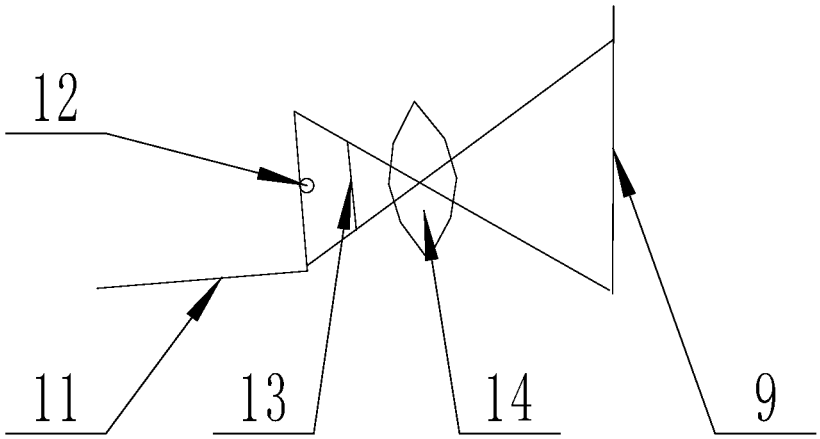
FIG. 5 is a structural schematic diagram of a color flame projector in embodiment 3 of the present invention.

As shown in FIG. 5, the color tube 12 is composed of a vitelline LED tube. Others are same as in embodiment 1.

Embodiment 4

Figure 6:
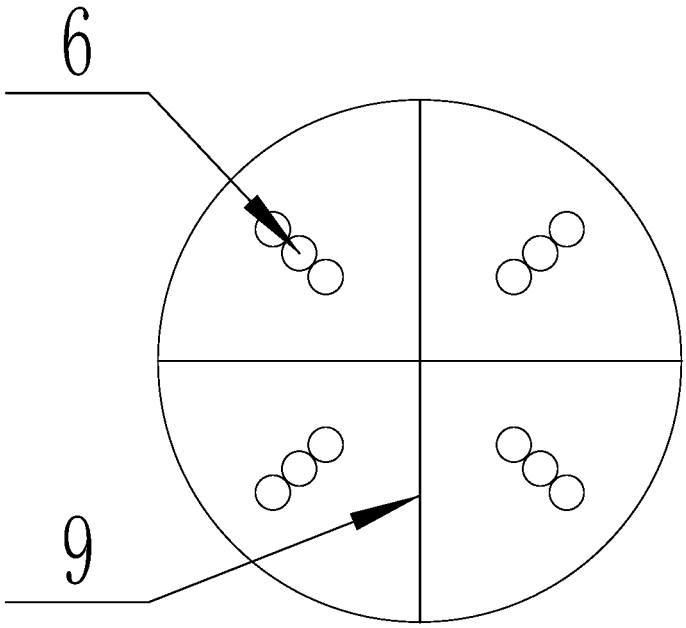
FIG. 6 is a structural schematic diagram of an included angle reflecting screen in embodiment 4 of the present invention.

As shown in FIG. 6, four color flame projectors 6 matched with the included angle reflecting screen are arranged on the plastic shell above the spring, the included angle reflecting screen 5 is jointly formed by four milky films 9 distributed on the same center line at equal angles, the included angle between two adjacent milky films is 90 degrees, and a circular hole 10 for sleeving on the metal wire is formed at the lower end of the center line; the quantity of the color flame projectors 6 is the same as that of the milky films, the tour color flame projectors are distributed on the same circumference at equal angles with the included angle reflecting screen as a center, and each color flame projector is located in a relationship of one-to-one correspondence with the included angle between the two adjacent milky films. Others are same as in embodiment 1.

Embodiment 5

Figure 7:
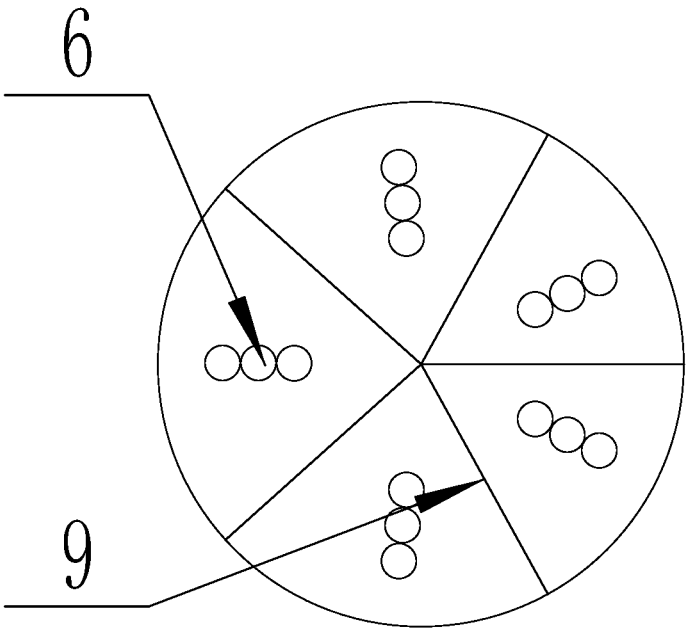
FIG. 7 is a structural schematic diagram of an included angle reflecting screen in embodiment 5 of the present invention.

As shown in FIG. 7, five color flame projectors 6 matched with the included angle reflecting screen are arranged on the plastic shell above the spring, the included angle reflecting screen 5 is jointly formed by five milky films 9 distributed on the same center line at equal angles, the included angle between two adjacent milky films is 72 degrees, and a circular hole 10 for sleeving on the metal wire is formed at the lower end of the center line; the quantity of the color flame projectors 6 is the same as that of the milky films, the five color flame projectors are distributed on the same circumference at equal angles with the included angle reflecting screen as a center, and each color flame projector is located in a relationship of one-to-one correspondence with the included angle between the two adjacent milky films. Others are same as in embodiment 1.

Embodiment 6

Figure 8:
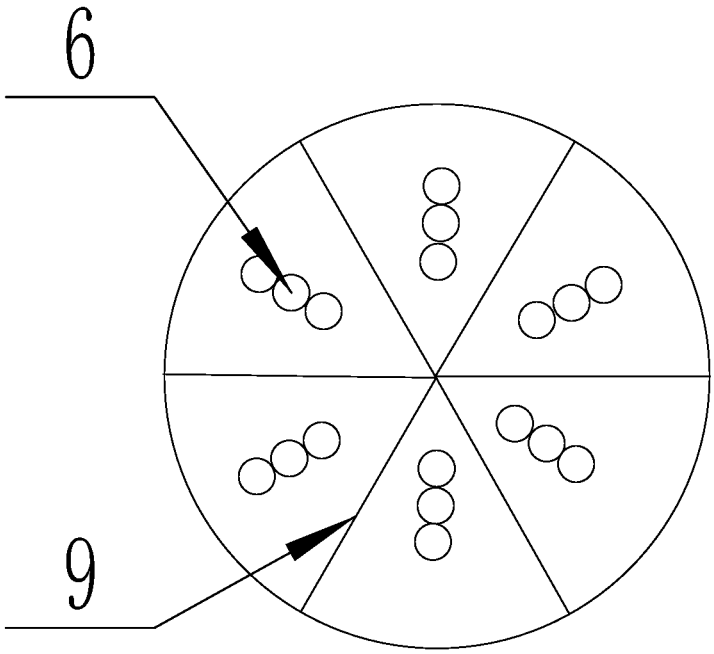
FIG. 8 is a structural schematic diagram of an included angle reflecting screen in embodiment 6 of the present invention.

As shown in FIG. 8, six color flame projectors 6 matched with the included angle reflecting screen are arranged on the plastic shell above the spring, the included angle reflecting screen 5 is jointly formed by six milky films 9 distributed on the same center line at equal angles, the included angle between two adjacent milky films is 60 degrees, and a circular hole 10 for sleeving on the metal wire is formed at the lower end of the center line; the quantity of the color flame projectors 6 is the same as that of the milky films, the six color flame projectors are distributed on the same circumference at equal angles with the included angle reflecting screen as a center, and each color flame projector is located in a relationship of one-to-one correspondence with the included angle between the two adjacent milky films. Others are same as in embodiment 1.

Embodiment 7

Figure 9:
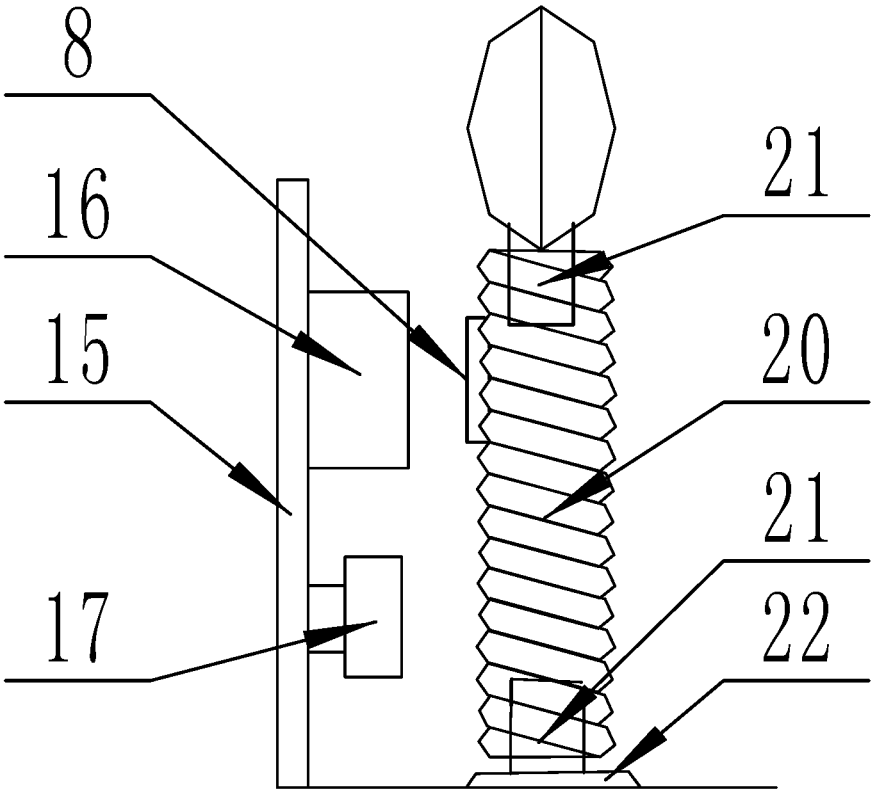
FIG. 9 is a structural schematic diagram of a driver part in embodiment 7 of the present invention.

As shown in FIG. 9, the supporting rod 7 with the concave point, the metal ring 4 and the metal hook 19 are removed, the original spring is replaced by a long spring 20, a positioning column 21 fixedly connected with the included angle reflecting screen is inserted into the upper end of the long spring, a positioning column 21 fixedly connected with a base 22 is also inserted into the lower end of the long spring, the circuit board 15 is erected on the base, the power supply 17 and the electromagnetic coil 16 are mounted on the circuit board 15, the soft iron sheet located corresponding to the electromagnetic coil is arranged on the lateral surface of the long spring. Others are same as in embodiment 1.

Embodiment 8

Figure 10:
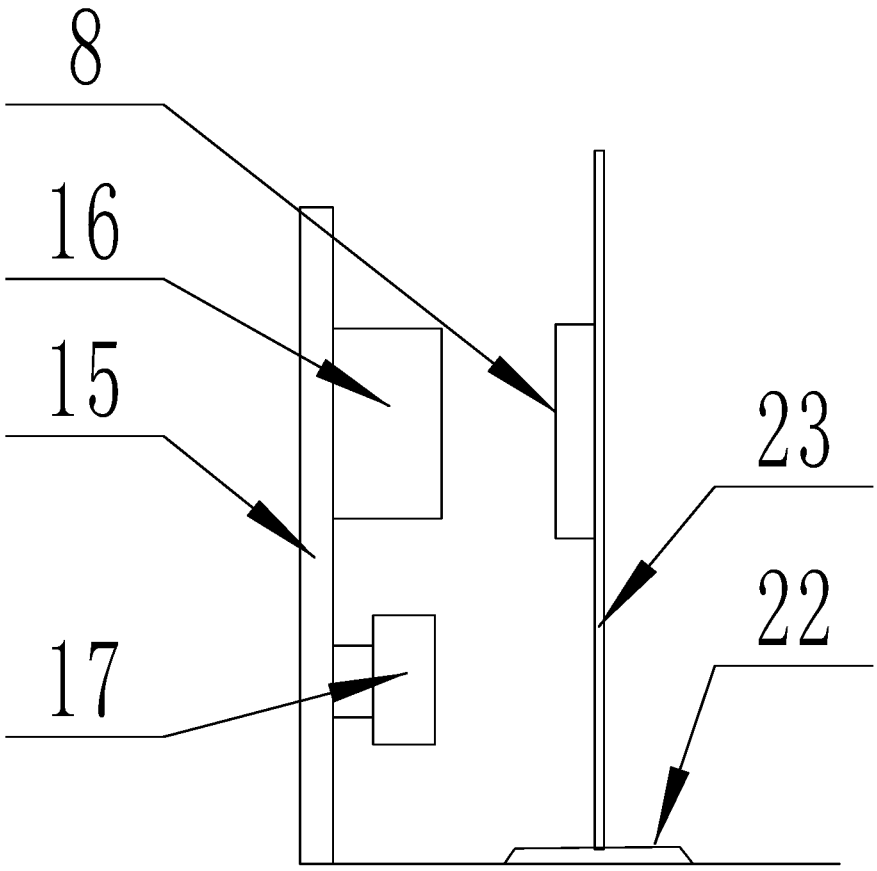
FIG. 10 is a structural schematic diagram of a driver part in embodiment 8 of the present invention.

As shown in FIG. 10, the long spring and the positioning columns positioned at the upper and lower ends of the long spring in embodiment 7 are replaced by a linear spring 23. Others are same as in embodiment 1.

The above technical solutions merely embody preferred ones of the technical solutions of the present invention, some alterations which may be made to some parts thereof by those skilled in the art embody the principle of the present invention, and fall into the protection scope of the present invention.

The invention claimed is:

1. An electronic candle, comprising a plastic wrapper and a white wax shell (1) therein, wherein a spring (2) is arranged inside the plastic wrapper and the white wax shell (1) therein, an upright metal wire (3) is arranged at the upper end of the spring, a metal ring (4) is arranged at the lower end of the spring, the metal wire is sleeved with an included angle reflecting screen (5), a plurality of color flame projectors (6) matched with the included angle reflecting screen are arranged on the plastic shell above the spring, a supporting rod (7) with a concave point is arranged on the white wax shell below the spring, the supporting rod with the concave point transversely penetrates through the metal ring, a metal hook (19) is arranged at the lower end of the metal ring, a soft iron sheet (8) is connected to the metal hook, and a driver for driving the soft iron sheet to swing and an overall power supply for supplying power to the driver and the color flame projectors are arranged below the soft iron sheet.

2. The electronic candle of claim I, wherein the included angle reflecting screen (5) is formed jointly by a plurality of milky films (9) distributed on the same center line at equal angles, and a circular hole (10) for sleeving on the metal wire is thrilled at the lower end of the center line.

3. The electronic candle of claim 1, wherein the quantity of the plurality of color flame projectors (6) is the same as that of the milky films, the plurality of color flame projectors are distributed on the same circumference at equal angles with the included angle reflecting screen as a center, and each color flame projector is located in a relationship of one-to-one correspondence with the included angle between two adjacent milky films.

4. The electronic candle of claim 3, wherein each color flame projector (6) is jointly composed of a support (11), color tubes (12) arranged on the support, a color flame film (13) and a convex lens (14).

5. The electronic candle of claim 4, wherein the color tubes (12) are jointly composed of red, white and yellow LED tubes.

6. The electronic candle of claim 1, wherein the driver is composed of a circuit board (15) and an electromagnetic coil (16) fixed on the circuit board.

7. The electronic candle of claim 1, wherein the overall power supply is formed by connecting a power supply (17) and a power switch (18) in series.

8. The electronic candle of claim 5, 6 or 7, wherein the power supply (17) and the power switch (18) are respectively electrically connected with the circuit board to form a closed circuit, and the circuit board is electrically connected with the color tubes.

9. The electronic candle of claim 2, wherein the included angle between the two adjacent milky films of the included angle display screen (5) is 0-120 degrees.

10. The electronic candle of claim 1, wherein the metal ring (4) is positioned within an area of the supporting rod where the concave point is located.

* * * * *